United States Patent [19]

Ben-Gal et al.

[11] Patent Number: 4,822,315

[45] Date of Patent: Apr. 18, 1989

[54] TOY CONSTRUCTION APPARATUS

[76] Inventors: Ofer Ben-Gal, Simtat Avivim 6, Kfar Saba; Nissim Sabatov, Alterman 11, Tel Aviv, both of Israel

[21] Appl. No.: 108,416

[22] Filed: Oct. 13, 1987

[51] Int. Cl.[4] ..... A63H 33/04

[52] U.S. Cl. ..... 446/102; 446/104; 446/487

[58] Field of Search ..... 446/102, 115, 116, 120, 446/121, 122, 124, 125, 127, 104, 108, 487; 403/375, 380, 381

[56] References Cited

U.S. PATENT DOCUMENTS

| | | | |
|---|---|---|---|
| 409,744 | 8/1889 | Garben | 446/104 |
| 2,354,485 | 7/1944 | Slaughter | 446/108 X |
| 2,454,307 | 3/1988 | Cooley | 52/594 |
| 2,714,269 | 8/1955 | Charles | 446/121 X |
| 2,972,833 | 2/1961 | Grutta | 446/121 |
| 3,009,719 | 11/1961 | Otto et al. | 446/115 X |
| 3,066,436 | 3/1988 | Schuh | 446/115 |
| 3,192,738 | 7/1965 | Charles et al. | 446/121 X |
| 3,591,973 | 7/1971 | Fischer | 446/127 |
| 4,035,947 | 7/1977 | Burge | 446/127 |
| 4,055,019 | 3/1988 | Harvey | 446/115 |
| 4,078,328 | 3/1978 | Rayment | 446/102 |
| 4,519,724 | 5/1985 | Ribas | 446/115 X |

FOREIGN PATENT DOCUMENTS

| | | | |
|---|---|---|---|
| 1236621 | 3/1967 | Fed. Rep. of Germany | 446/124 |
| 1903159 | 10/1970 | Fed. Rep. of Germany | 446/120 |
| 1159942 | 7/1958 | France | 446/124 |

*Primary Examiner*—Robert A. Hafer
*Assistant Examiner*—Sam Rimell
*Attorney, Agent, or Firm*—Ladas & Parry

[57] ABSTRACT

An assembly toy comprising a plurality of engaged interconnectable elements, each interconnectable element including a generally planar surface and comprising at least one engagement portion selected from first and second types of mutually interconnectable engagement portions, individual ones of the first and second types of mutually interconnectable engagement portions, when engaged permitting relative displacement of the elements interconnected thereby with a plurality of degrees of freedom.

8 Claims, 10 Drawing Sheets

FIG.6A
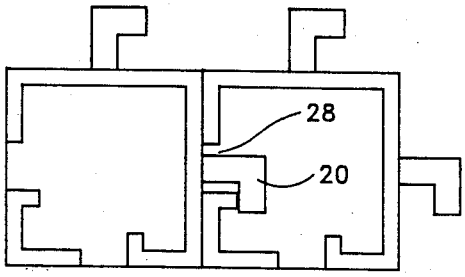
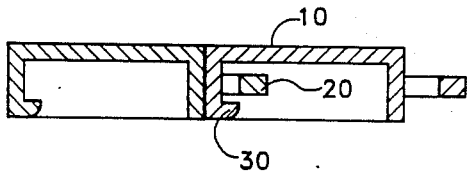
FIG.7B
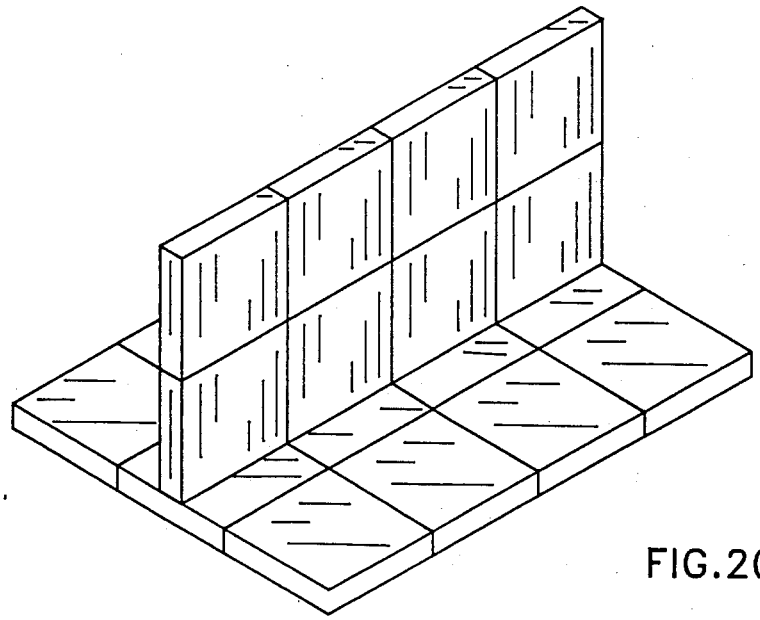
FIG.20

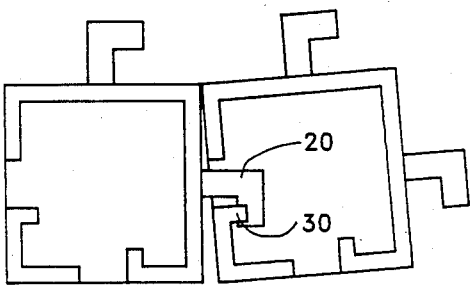
FIG.9A
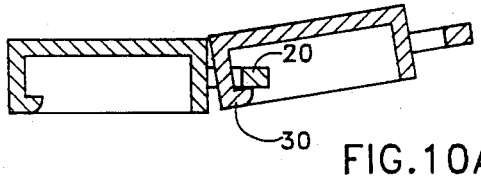
FIG.10A
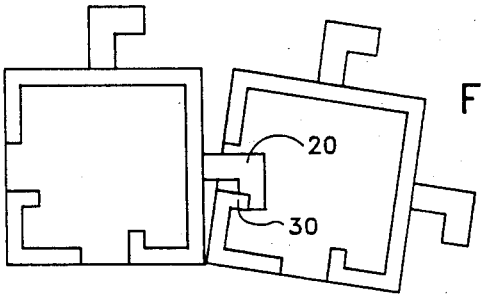
FIG.9B
FIG.10B
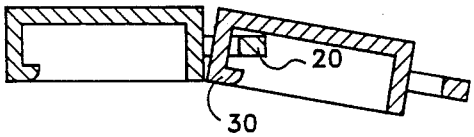
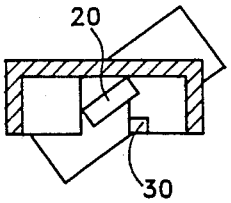
FIG.11A
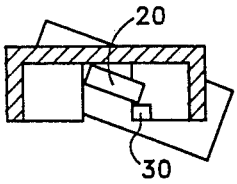
FIG.11B FIG. 14
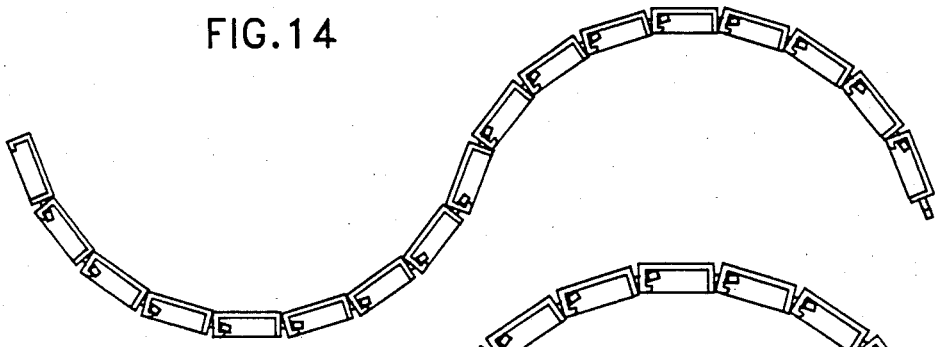
FIG. 13
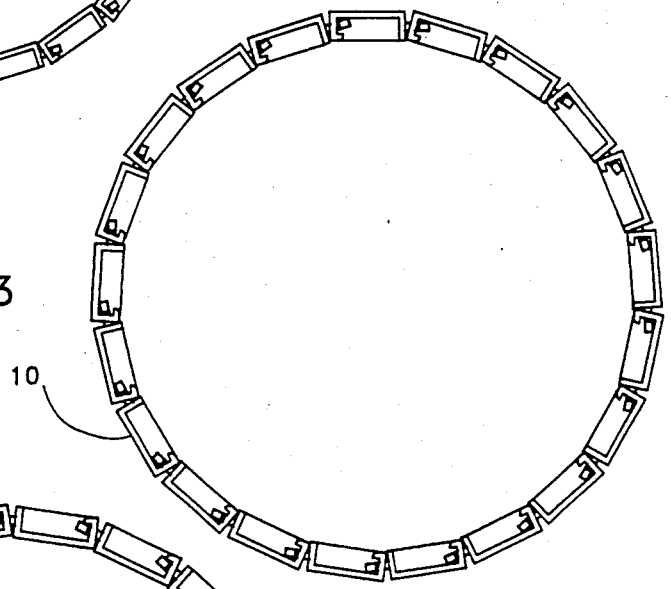
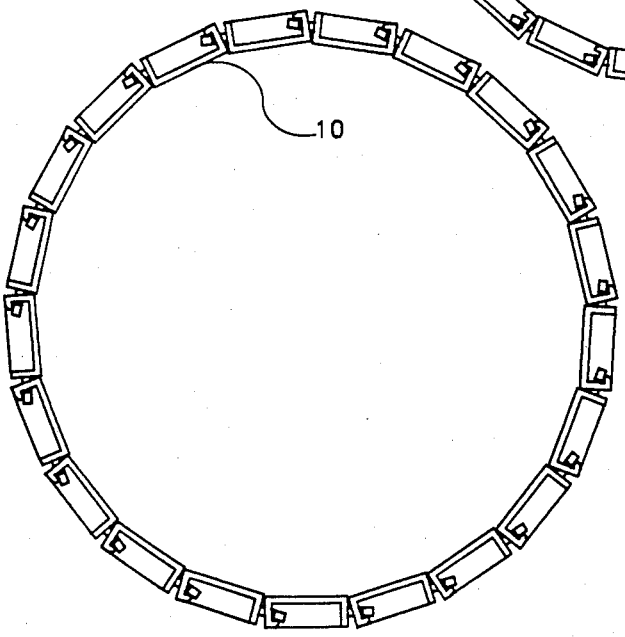
FIG. 12

FIG.16
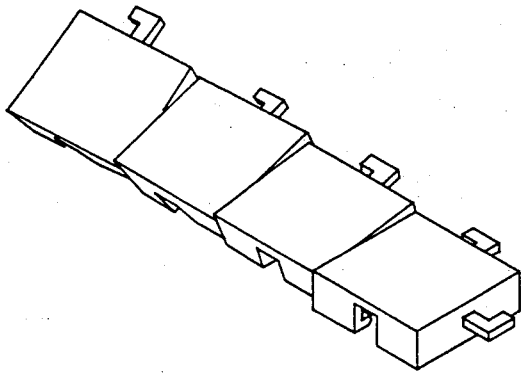
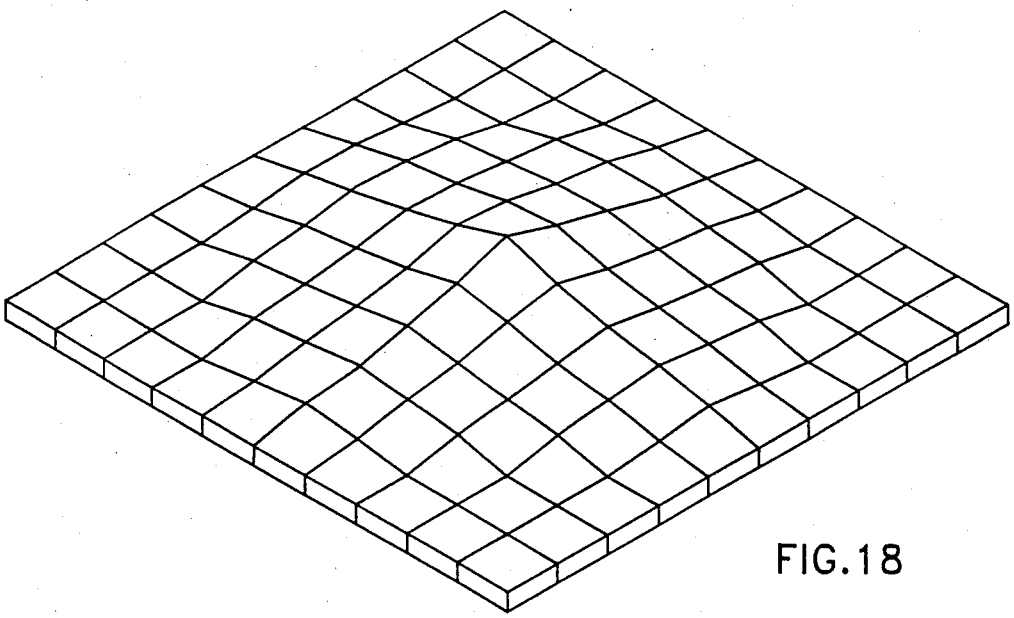
FIG.18

FIG.19
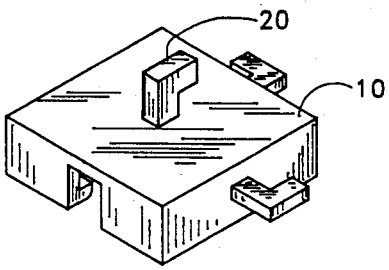
FIG.23
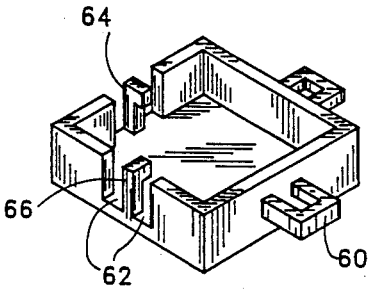
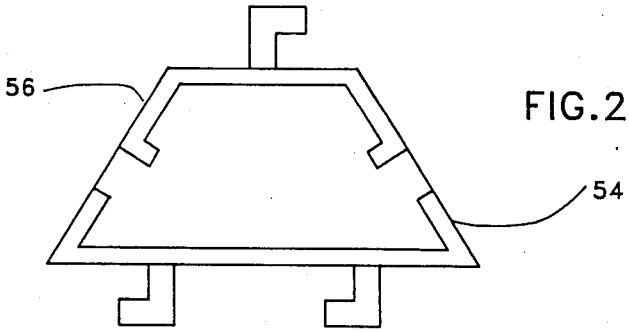
FIG.21
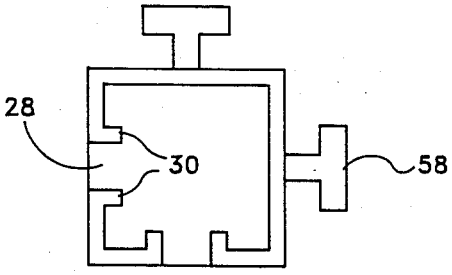
FIG.22

TOY CONSTRUCTION APPARATUS

FIELD OF THE INVENTION

The present invention relates to assembly toys generally and more particularly to interconnectable assembly tiles.

BACKGROUND OF THE INVENTION

Various types of interconnectable assembly tiles are known in the prior art. U.S. Pat. No. 2,454,307 to Cooley shows the formation of mosaic patterns through the interlocking of small sections of flexible material. U.S. Pat. No. 2,454,307 apparently envisions only the creation of two-dimensional articles, the flexibility being provided to enable engagement and disengagement of the elements.

U.S. Pat. No. 3,066,436 to Schuh describes toy construction apparatus, including a plurality of elements each comprising a tongue and a tongue receiving slot, for providing interconnection of the elements. In order to obtain planar configurations, Schuh would appear to require the use of very flexible material.

U.S. Pat. No. 4,055,019 to Harvey describes a constructional toy including a plurality of hingeable elements which may be used to create either two dimensional or three dimensional objects. It is noted that in the Harvey structure each hinged connection provides only a single degree of freedom, i.e. rotation about the defined axis of rotation.

SUMMARY OF THE INVENTION

The present invention seeks to provide an improved interconnectable assembly toy having features which are not present in the prior art.

There is thus provided in accordance with a preferred embodiment of the present invention an assembly toy comprising a plurality of interconnectable elements, each interconnectable element having a generally planar surface and comprising at least one engagement portion selected from first and second types of mutually interconnectable engagement portions, individual ones of the first and second types of mutually interconnectable engagement portions, when engaged permitting relative displacement of the elements interconnected thereby with a plurality of degrees of freedom.

In accordance with a preferred embodiment of the present invention, the engagement portions are configured such that when individual ones of the first and second types of mutually interconnectable engagement portions are engaged, six degrees of freedom are provided for relative displacement of the elements interconnected thereby.

Further in accordacne with a preferred embodiment of the invention, the six degrees of freedom include axial, lateral (side to side), transverse (up - down), and rotation about three perpendicular axes.

Additionally in accordance with a preferred embodiment of the invention, the engagement portions are configured such that when individual ones of the first and second types of mutually interconnectable engagement portions are engaged, relative rotation of engaged elements about either of two perpendicular axes beyond predetermined limits produces disengagement rather than breakage of the interconnected elements.

Further in accordance with a preferred embodiment of the invention, the engagement portions of the first type each comprise a protrusion including an axial portion and a lateral portion.

Additionally in accordance with a preferred embodiment of the invention, the lateral portion extends in a single direction from the axial portion. Alternatively, the lateral portion may extend in two directions from the axial portion.

Further in accordance with a preferred embodiment of the invention, the engagement portions of the second type comprise a slot for accomodating the axial portion and a spacer catch disposed alongside the slot and extending only partially therealong.

Additionally in accordance with a preferred embodiment of the invention, the engagement arrangement of individual engagement portions of the first and second type is such that axial portion extends through the slot and lateral portion lies beyond the spacer catch.

Further in accordance with a preferred embodiment of the invention, the engagement portions are configured that upon engagement and disengagement of individual elements, the transverse portion must pass the spacer catch.

Additionally in accordance with a preferred embodiment of the invention, the spacer catch is configured to have an axial dimension generally equal to the axial dimension of the axial portion, thus permitting traverse displacement of the lateral portion therepast only when two adjacent elements are in coplanar touching engagement.

Further in accordance with a preferred embodiment of the present invention, the spacer catch is formed with a rounded surface for facilitating traversal thereof by the lateral portion.

Additionally in accordance with a preferred embodiment of the present invention, there is provided a three dimensional object formed by a multiplicity of joined elements of the type described hereinabove.

Further in accordance with an embodiment of the present invention, the three dimensional object includes relatively displaceable portions which may be displaced without producing disengagement of the joined elements.

BRIEF DESCRIPTION OF THE DRAWINGS

The present invention will be understood and appreciated more fully from the following detailed description, taken in conjunction with the drawings in which:

FIGS. 6A and 6B are bottom views showing the inner and outer limits of axial relative displacement of two engaged elements of the type shown in FIGS. 1A and 1B;

FIGS. 7A and 7B are side sectional views corresponding to FIGS. 6A and 6B;

FIGS. 9A and 9B are bottom views showing the right and left limits of yaw rotation of two engaged elements of the type shown in FIGS. 1A and 1B;

FIGS. 10A and 10B are side sectional views showing the up and down limits of pitch rotation of two engaged elements of the type shown in FIGS. 1A and 1B;

FIGS. 11A and 11B are sectional views showing the limits of roll rotation of two engaged elements of the type shown in FIGS. 1A and 1B;

FIG. 12 is a sectional illustration of a multiplicity of elements of the type shown in FIGS. 1A and 1B engaged in a first orientation to define a cylindrical body;

FIG. 13 is a sectional illustration of a multiplicity of elements of the type shown in FIGS. 1A and 1B engaged in a second orientation to define a cylindrical body;

FIG. 14 is a sectional illustration of a multiplicity of elements of the type shown in FIGS. 1A and 1B engaged in relative orientations having two different pitches;

FIG. 16 is a pictorial illustration of a multiplicity of elements of the type shown in FIGS. 1A and 1B engaged in a series of orientations displaced by a given amount of roll;

FIG. 18 is a pictorial illustration of an object formed of a multiplicity of elements of type shown in FIGS. 1A and 1B interconnected with differing axial, transverse and lateral spacing and differing pitch, yaw and roll rotation;

FIG. 19 is a pictorial illustration of an alternative configuration of element constructed and operative in accordance with a preferred embodiment of the present invention;

FIG. 20 is a pictorial illustration of an object constructed using elements of the type shown in FIG. 19;

FIG. 21 is a bottom view illustration of yet another alternative configuration of element constructed and operative in accordance with a preferred embodiment of the present invention;

FIG. 22 is a bottom view illustration of still another alternative configuration of element constructed and operative in accordance with a preferred embodiment of the present invention;

FIG. 23 is a bottom view illustration of a further alternative configuration of element constructed and operative in accordance with a preferred embodiment of the present invention.

DETAILED DESCRIPTION OF PREFERRED EMBODIMENTS

Figure 1A:
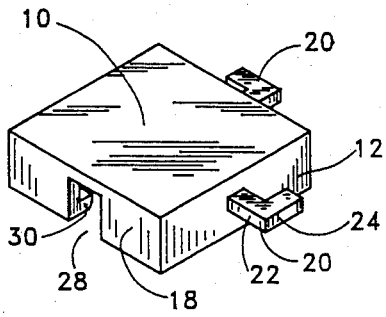
FIGS. 1A and 1B are respective top and bottom perspective views of an interconnectable element constructed and operative in accordance with a preferred embodiment of the present invention.
Figure 1B:
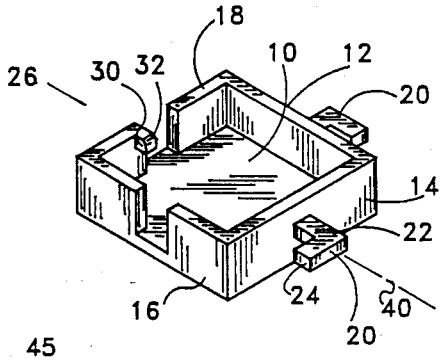

Reference is now made to FIGS. 1A and 1B which illustrate an interconnectable tile element constructed and operative in accordance with a preferred embodiment of the present invention. The element comprises a generally planar surface 10, typically of square configuration and four edge panels 12, 14, 16, and 18, extending perpendicularly with respect to planar surface 10, so as to define the sides of a platform of which surface 10 is the platform surface.

Associated with at least one surface of the interconnectable tile element and as shown associated with each of the side panels is an engagement portion. The engagement portions are of two types. An engagement portion of a first type 20 is seen associated with each of edge panels 12 and 14 and includes an axial portion 22 which extends perpendicularly outward from the edge panel and a lateral portion 24 which extends perpendicularly and to at least one side of axial portion 22. Lateral portion 24 is separated from the edge panel by a defined clearance distance.

An engagement portion of a second type 26 comprises a slot 28 formed in a edge panel, such as edge panels 16 and 18, and a spacer catch 30 disposed alongside slot 28. Spacer catch 30 extends perpendicularly inward from the outer surface of the edge panel by a distance which is generally equal to the clearance distance. Spacer catch 30 is typically formed with a rounded corner 32 adjacent to the entrance to the slot 28 to assist in engagement, but may alternatively be formed with a squared corner.

It will be noted that spacer catch 30 does not extend adjacent the entire length of the slot 28, but rather only a portion of the slot, adjacent the entrace to the slot. Typically, spacer catch 30 extends along about one-third of the length of the slot.

It is a particular feature of the present invention that the configuration of the engagement portions of the first and second type provides engagement of first and second type engagement portions which is flexible and permits multiple degree of freedom relative movement of engaged elements while being resistant to undesired disengagement.

It is also a particular feature of the present invention that the first and second types of engagement portions are configured such that when individual ones of the first and second types of mutually interconnectable engagement portions are engaged, relative rotation of engaged elements about either of two perpendicular axes beyond predetermined limits produces disengagement rather than breakage of the interconnected elements. Such axes are, for example, axes 45 and 49 (FIG. 2).

Figure 2:
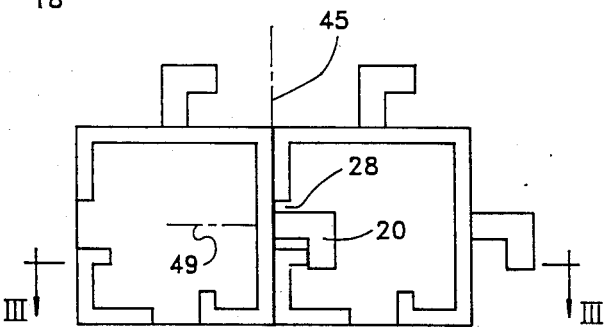
FIG. 2 is a bottom planar view of a pair of interconnected elements of the type shown in FIGS. 1A and 1B.
Figure 4:
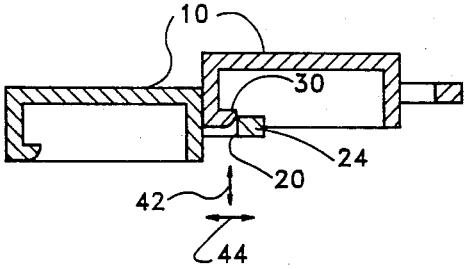
FIG. 4 is a side sectional view of transverse engagement or disengagement of two elements of the type shown in FIGS. 1A and 1B.
Figure 3:
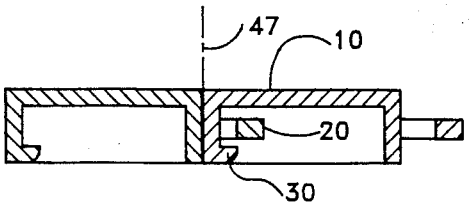
FIG. 3 is a side sectional view corresponding to FIG. 2 and taken along the lines III—III in FIG. 2.

Reference is now made to FIGS. 2–4, which illustrate engagement of two interconnectable elements in accordance with a preferred embodiment of the present invention. For the purpose of clarity in description, the following terminology will be used throughout. "Axial" refers to the longitudinal axis 40 (FIG. 1B) of the axial portion 22 of the engagement portion of the first type; "transverse" refers to movement along an up-down axis 42 (FIG. 4) perpendicular to the longitudinal axis 40; and "lateral" refers to movement along a side to side axis 44 ( FIG. 4) perpendicular to axes 40 and 42. "Pitch" refers to rotation about an axis 45 (FIG. 2); "yaw" refers to rotation about an axis 47 (FIG. 3); and "roll" refers to rotation about an axis 49 (FIG. 2).

From a consideration of FIGS. 2 and 3, it can be seen that locked engagement of two interconnectable elements is provided when the engagement portion 20 of a first element extends through slot 28 of a second element, such that the lateral portion 24 is clear of the spacer catch 30. In this orientation, according to the present invention, 6 degrees of freedom for relative displacement of the engaged elements are provided.

It may be seen from FIG. 4 that engagement and disengagement of two elements through relative transverse movement thereof may be realized only if the edge panels of the respective elements lie in parallel touching relationship. When the edge panels of the respective elements lie in parallel touching relationship, the lateral portion 24 can pass the spacer catch 30 so as to assume the locked orientation shown in FIGS. 2 and 3.

It will be appreciated that the interconnectable elements may be formed of any suitably high strength material such as ABS plastic. The inherent flexibility of such material may influence the dimensional tolerances of the engagement portions. For example, if a material of sufficient flexibility is employed, then the relevant dimension of the spacer catch 30 may be slightly larger than the clearance distance for providing a snap engagement arrangement.

Figure 8A:
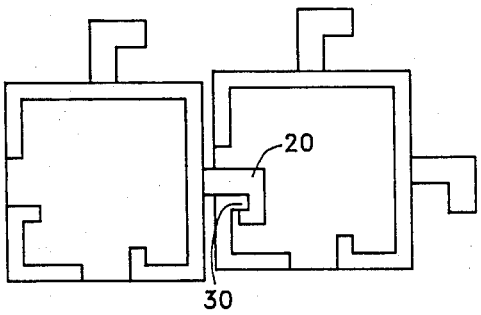
FIGS. 8A and 8B are bottom views showing the right and left limits of lateral relative displacement of two engaged elements of the type shown in FIGS. 1A and 1B.
Figure 5A:
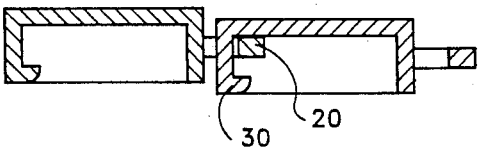
FIGS. 5A and 5B are side sectional views showing the upper and lower limits of up-down (transverse) relative displacement of two engaged elements of the type shown in FIGS. 1A and 1B.
Figure 8B:
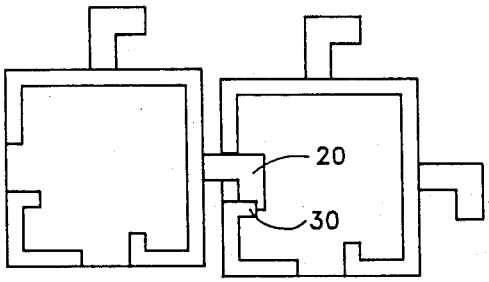
Figure 5B:
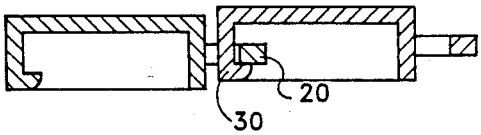
Figure 6B:
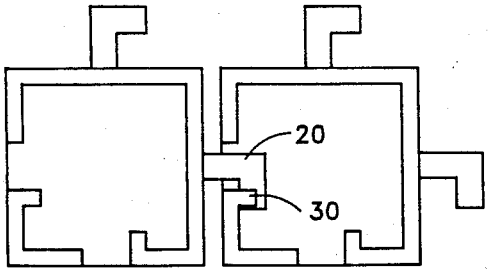
Figure 7A:
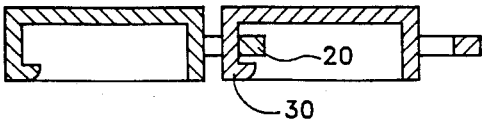

It is a particular feature of the present invention that engagement of the interconnectable elements formed in accordance with the present invention permits relative movement of engaged interconnectable elements with multiple degrees of freedom. FIGS. 5A and 5B illustrate extremes of relative transverse displacement of engaged (locked) elements. FIGS. 6A, 6B, 7A and 7B illustrate extremes of relative axial displacement of engaged elements. FIGS. 8A and 8B illustrate extremes of relative lateral displacement of engaged elements.

FIGS. 9A and 9B illustrate extremes of yaw rotation, while FIGS. 10A and 10B illustrate extremes of pitch rotation and FIGS. 11A and 11B illustrate extremes of roll rotation, all for engaged (locked) elements.

FIG. 12 illustrates the arrangement of a multiplicity of interconnectable elements according to the present invention arranged with their surfaces 10 facing inwardly in a cylindrical configuration. FIG. 13 illustrates a similar configuration wherein the surfaces 10 face outwardly.

Figure 15:
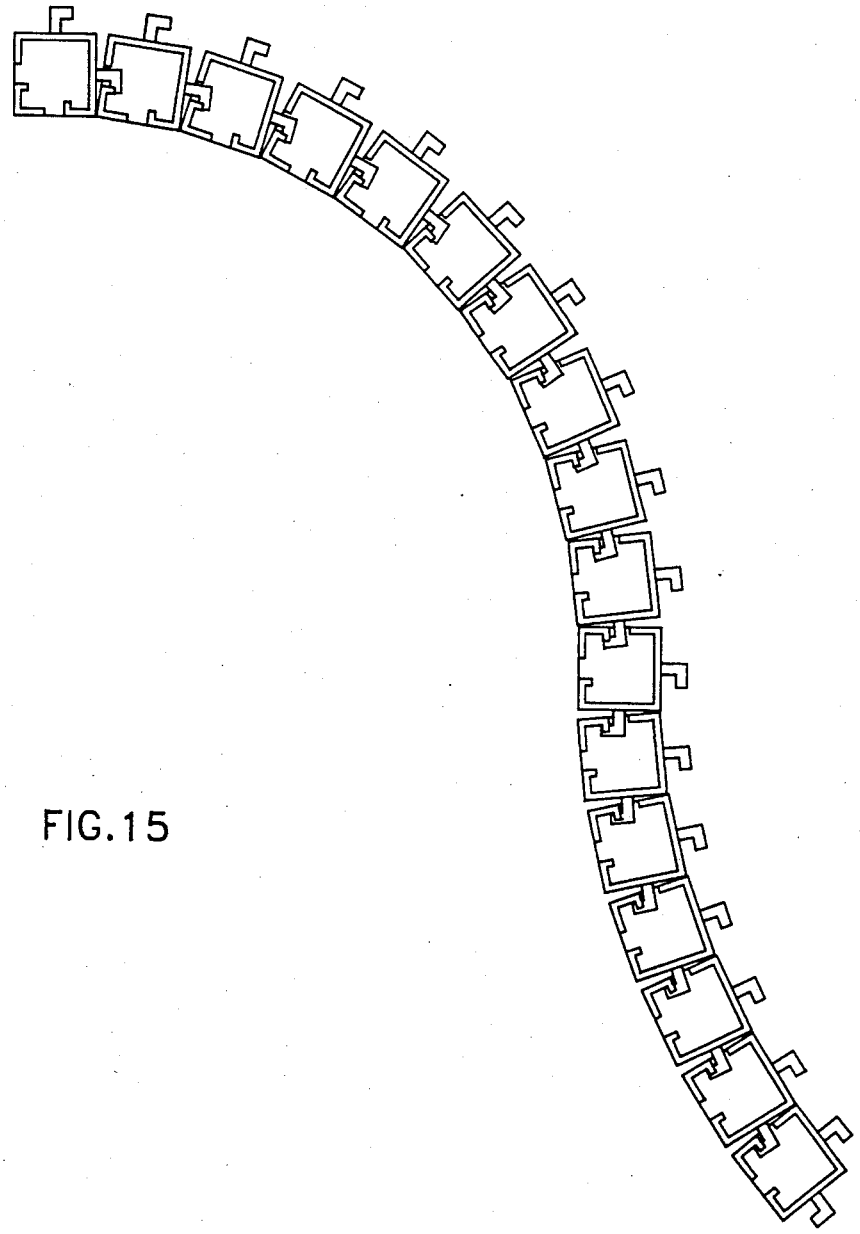
FIG. 15 is a bottom view illustration of a multiplicity of elements of the type shown in FIGS. 1A and 1B engaged in relative orientations having two different yaws.

FIG. 14 is a sectional illustration of a multiplicity of elements of the type shown in FIGS. 1A and 1B engaged in relative orientations having two different pitches. FIG. 15 is a bottom view illustration of a multiplicity of elements of the type shown in FIGS. 1A and 1B engaged in relative orientations having two different yaws. FIG. 16 is a pictorial illustration of a multiplicity of elements of the type shown in FIGS. 1A and 1B engaged in a series of orientations displaced by a given amount of roll.

Figure 17:
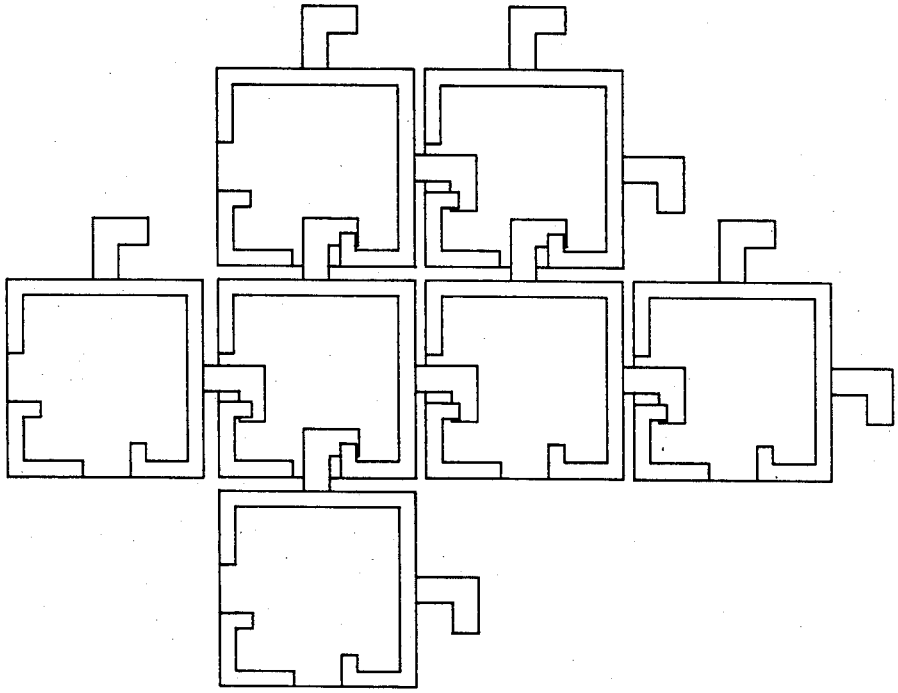
FIG. 17 is a bottom view illustration of a multiplicity of elements of the type shown in FIGS. 1A and 1B engaged in a planar arrangement wherein the axial and lateral spacing of each element from each adjacent element is intermediate the limits.

FIG. 17 illustrates a generally planar array of engaged interconnectable elements. FIG. 18 illustrates an object defined by a multiplicity of engaged interconnectable elements having differing axial, transverse and lateral separations as well as differing pitch, yaw and roll relative rotational orientations.

FIG. 19 illustrates an alternative embodiment of interconnectable element wherein an additional engagement portion of the first type 20 is disposed on surface 10. FIG. 20 illustrates an object, including a perpendicularly extending wall which may be constructed using elements of the type shown in FIG. 19 to support the upstanding wall.

FIG. 21 illustrates another alternative embodiment of interconnectable element, which serves to illustrate the face that in accordance with the present invention, the interconnectable elements may have any desired number of engagement portions of the first and second types and any desired suitable element configuration. In the illustrated embodiment non-parallel edge panels 54 and 56 are provided.

FIG. 22 illustrates yet another alternative embodiment of interconnectable element, wherein the engagement portion of the first type includes a lateral portion 58 which extends to both sides of the axial portion. Correspondingly a pair of spacer catches 30 are associated with the two sides of the slot 28.

FIG. 23 illustrates still another alternative embodiment of interconnectable element wherein the engagement portion of the first type comprises a lug shaped hook 60 and the engagement portion of the second type comprises a bifurcated slot 62 having a spacer catch 64 mounted on a central stem 66, for engagement with the lug.

Figure 24:
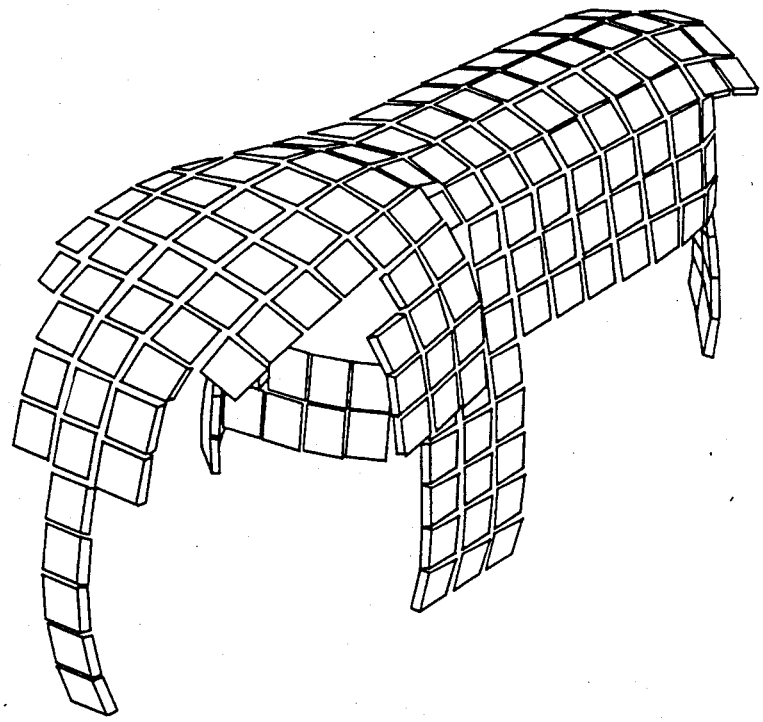
FIG. 24 is a pictorial illustration of a fanciful object constructed in accordance with the present inventon.

FIG. 24 illustrates a fanciful figure constructed in accordance with the present invention. It is a particular feature of the present invention that the figure has inherent flexibility and can thus be re-positioned, reshaped, re-posed and re-oriented without disengagement of the individual elements from adjacent elements, thus enhancing the play value thereof.

It will be appreciated by persons skilled in the art that the present invention is not limited to what has been specifically shown and described hereinabove. Rather the scope of the invention is defined only by the claims which follow:

We claim:

1. An assembly toy comprising a flexible generally planar array of removably interconnectable tile elements, each interconnectable tile element having a generally planar wall and a plurality of upstanding side walls arranged at the periphery of said generally planar wall and extending generally perpendicular thereto to an edge, said plurality of upstanding side walls having a first thickness and comprising:

at least one upstanding side wall having formed thereon an engagement socket defined by a slot formed in the upstanding side wall which extends to said edge thereof; and a retaining protrusion arranged adjacent the slot, said retaining protrusion extending beyond said wall with a second thickness; and at least one upstanding side wall having formed thereon an engagement element including an axial portion extending outwardly from said side wall and a lateral portion extending laterally from said axial portion at a location spaced from said side wall by a first distance;

said engagement socket and said engagement element being configured such that upon engagement of said engagement element with said engagement socket, said axial portion extends through the slot and said lateral portion lies beyond the retaining protrusion;

said engagement socket and said engagement element being configured such that said first distance is approximately equal to the sum of the first and second thicknesses, whereby engagement and disengagement of the engagement socket and engagement element on separate tile elements may be achieved by relative motion of the tile elements parallel to their respective side walls and parallel to said slot when the side walls are in touching relationship and whereby once the tile elements are engaged the interconnection therebetween permits relative pitch, roll and yaw rotation therebetween without producing disengagement.

2. An assembly toy according to claim 1 and wherein said engagement socket and said engagement element are configured such that six degrees of freedom are provided for relative displacement of the tile elements interconnected thereby.

3. An assembly toy according to claim 2 and wherein said six degrees of freedom include axial, lateral (side to side), transverse (up - down), and rotation about three perpendicular axes.

4. An assembly toy according to claim 1 and wherein said engagement socket and engagement element are configured such that when engagement socket and engagement element are engaged, relative rotation thereof about either of two perpendicular axes beyond predetermined limits produces disengagement rather than breakage of the interconnected elements.

5. An assembly toy according to claim 1 and wherein the lateral portion extends in a single direction from the axial portion.

6. An assembly toy according to claim 1 and wherein said engagement socket and engagement element are configured that upon engagement and disengagement of individual elements, the lateral portion must pass the retaining protrusion.

7. An assembly toy according to claim 1 and wherein said retaining protrusion is formed with a rounded surface for facilitating traversal thereof by the lateral portion.

8. A three dimensional object formed by a multiplicity of joined interconnectable tile elements, each interconnectable tile element having a generally planar wall and a plurality of upstanding side walls arranged at the periphery of said generally planar wall and extending generally perpendicular thereto to an edge, said plurality of upstanding side walls having a first thickness and comprising:

at least two upstanding side walls having formed thereon an engagement socket defined by a slot formed in the upstanding side wall which extends to said edge thereof; and a retaining protrusion arranged adjacent the slot, said retaining protrusion extending beyond said wall with a second thickness; and at least two upstanding side walls having formed thereon an engagement element including an axial portion extending outwardly from said side wall and a lateral portion extending laterally from said axial portion at a location spaced from said side wall by a first distance;

said engagement socket and said engagement element being configured such that upon engagement of said engagement element with said engagement socket, said axial portion extends through the slot and said lateral portion lies beyond the retaining protrusion;

said engagement socket and said engagement element being configured such that said first distance is approximately equal to the sum of the first and second thicknesses, whereby engagement and disengagement of the engagement socket and engagement element on separate tile elements may be achieved by relative motion of the tile elements parallel to their respective side walls and parallel to said slot when the side walls are in touching relationship and whereby once the tile elements are engaged the interconnection therebetewen permits relative pitch, roll and yaw rotation therebetween without producing disengagement permitting relative displacement of the tile elements interconnected thereby with a plurality of degrees of freedom, at least some of said multiplicity of tile elements being simultaneously engaged to four adjacent tile elements.

* * * * *